US005099594A

United States Patent [19]

Reas et al.

[11] Patent Number: 5,099,594

[45] Date of Patent: Mar. 31, 1992

[54] VEHICLE-MOUNTED MESSAGE DISPLAY WITH SUCTION CUPS AND INTERPOSED HOOK AND LOOP FASTENERS

[76] Inventors: John H. Reas, 18125 Constitution Ave., Monte Sereno, Calif. 95030; Marianne Mardesich, 1450 Yukon Dr., Sunnyvale, Calif. 94087

[21] Appl. No.: 430,625

[22] Filed: Oct. 30, 1989

[51] Int. Cl.[5] ..... G09F 7/16

[52] U.S. Cl. ..... 40/593; 40/597; 40/643; 211/89

[58] Field of Search ..... 40/588, 589, 590, 591, 40/592, 593, 594, 597, 489; 248/363, 205.5, 206.2, 206.3, 206.4, 206.5, 309.4, 309.3; 434/408; 24/306; 224/279; 211/86-89, 69.1

[56] References Cited

U.S. PATENT DOCUMENTS

| | | | |
|---|---|---|---|
| 1,840,763 | 1/1932 | Benchley | 248/206.3 |
| 2,825,988 | 3/1958 | O'Reilly | 40/642 |
| 3,239,178 | 3/1966 | Pompa | 248/205.3 |
| 3,289,338 | 12/1966 | Stephens | 40/600 |
| 3,914,890 | 10/1975 | Behlen, Jr. | 40/597 |
| 4,358,661 | 11/1982 | Kaderabek | 243/206.5 |
| 4,648,572 | 3/1987 | Sokol | 248/205.2 |
| 4,780,349 | 10/1988 | Gieske et al. | 248/205.2 |
| 4,800,662 | 1/1989 | Belrose | 40/621 |
| 4,852,282 | 8/1989 | Selman | 40/600 |
| 4,852,284 | 8/1989 | Faggiano | 40/600 |
| 4,858,357 | 8/1989 | Thorn | 40/584 |
| 4,876,811 | 10/1989 | Peltz | 40/586 |
| 4,888,893 | 12/1989 | Jones | 40/592 |
| 4,962,874 | 10/1990 | Hagglund | 224/277 |

FOREIGN PATENT DOCUMENTS 938806 12/1926 Fed. Rep. of Germany ..... 434/415

OTHER PUBLICATIONS

The Sporting Goods Dealer p. 193, JT Posey Sports, 3/1979.

The Sporting Goods Dealer, p. 377. JT Posey Sports, 3/1979.

*Primary Examiner*—Kenneth J. Dorner
*Assistant Examiner*—James M. Gardner
*Attorney, Agent, or Firm*—John J. Leavitt

[57] ABSTRACT

A dry-erase message board that can be vertically displayed on the interior surface of vehicle windows utilizing suction cups to initially secure the board to the vehicle window and having hook and pile pads between the board and the suction cups enabling the message board to be temporarily detached from the suction cups so that any desired message can be written, displayed, erased, or changed on the board and then reattached via the hook and pile pads to the suction cups still attached to the vehicle window. On the backside of the dry-erase board are additional hook and pile strips securing several dry-erase markers of different colors and a dry-erase board eraser.

5 Claims, 1 Drawing Sheet

VEHICLE-MOUNTED MESSAGE DISPLAY WITH SUCTION CUPS AND INTERPOSED HOOK AND LOOP FASTENERS

BACKGROUND OF THE INVENTION

1. Field of the Invention

This invention relates generally to a dry-erase message board that can display any user-desired message, art, or information, and particularly to a dry-erase board mountable to vehicles' interior windows that can be alternately and easily attached to and detached from said window via suction cups and "VELCRO"-like hook and pile pads.

2. Description of the Prior Art

Vehicle drivers and passengers who wish to display any message, viewpoint or information from their vehicles are limited to attaching bumper stickers on the vehicle's bumper, attaching decals on the windows or attaching a specific pre-written message or sign to their vehicle. A search for prior art regarding or relating to a vehicle-mounted dry-erase message board has revealed no patents in this subject area.

It is an object of the present invention to provide a dry-erase message board that a user can immediately write or draw upon and display in a vehicle's window.

Another object of the present invention is to provide such a message board that is changeable so that the user can quickly erase a previous message and then re-write or re-draw a new message at any time.

Still another object of the present invention is to provide a mounting means by which the message board quickly and easily adheres securely to a vehicle's window while also having the means to be quickly and easily detached from the window when it is to be drawn upon by the user.

Also, an object of the present invention is to provide a kit including several dry-erase markers of different colors and a dry-erase eraser, all easily secured to the backside of the dry-erase message board for convenient use by the user.

A further object of the present invention is to provide such a message board that is strong yet lightweight, durable and economical.

Further objects and advantages of the invention will become apparent from a consideration of the ensuing description and the accompanying drawings. It is to be understood however that the invention is not limited to the embodiment illustrated and described, since it may be embodied in various forms within the scope of the appended claims.

SUMMARY OF THE INVENTION

Vehicle drivers and passengers will find it desirable to have a dry-erase message board displayable from their vehicle'window that enables them to write or draw any message, then display this message while subsequently being able to erase the message and re-write or re-draw a new message. This dry-erase message board is easily and securely attached to the vehicle's window by the use of suction cups while also having the ability to be detached from both the suction cups and the window by means of "VELCRO"-like hook and pile pads located between the message board and the suction cups.

In terms of broad inclusion, the invention comprises an a elongated, flat, rectangularly-shaped dry-erase marking board with suction cups attached to the corners of the board via "VELCRO"-like hook and pile pads. The backside of the dry-erase board has several dry-erase markers of different colors and a dry-erase eraser, all attached via "VELCRO"-like hook and pile strips.

DESCRIPTION OF THE PREFERRED EMBODIMENT

Figure 1:
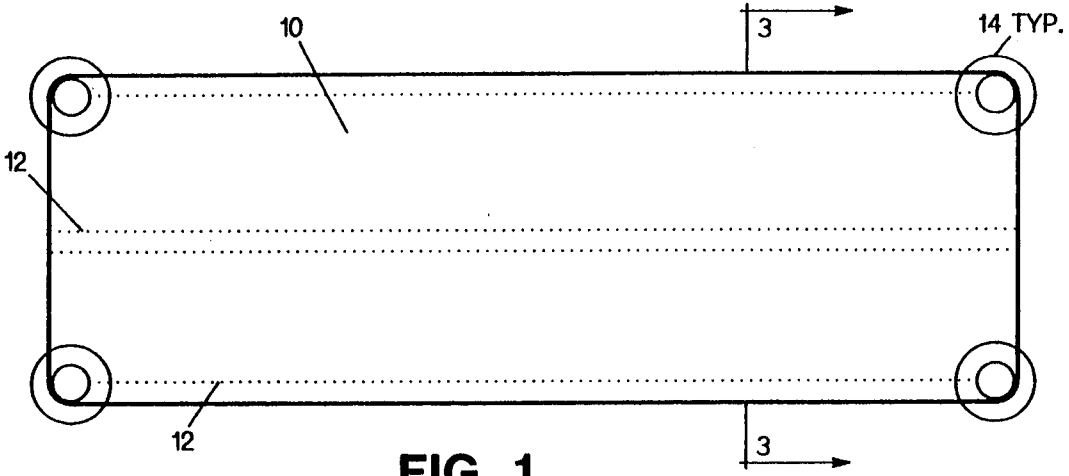
FIG. 1 is an elevational view of the display side of the dry-erase message board.
Figure 3:
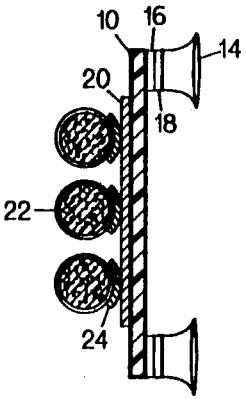
FIG. 3 is a cross-sectional view taken in the plane of line 3—3 of FIG. 1.

FIGS. 1 and 3 show the flat, elongated, rectangularly-shaped dry-erase marking board 10 with approximate dimensions of $12'' \times 3\frac{1}{2}'' \times \frac{1}{8}''$. Attached to the four corners of the board are four "VELCRO" hook pads 16 with approximate dimensions of $\frac{1}{2}'' \times \frac{1}{2}''$. Attached to these four hook pads 16 are four suction cups 14 that have four additional pieces of "VELCRO" pile pads 18 secured on the backside of the suction cups that are intended to match and mate with the message board's hook pads 16. FIG. 1 also shows the message board having faint broken guide lines 12 running parallel along the length of the board. The message board also has slightly rounded corners 30 for ease of handling by the user. Several dry-erase markers 22 are secured to the backside of the message board 10 by "VELCRO" hook strips 20 attached to the backside of the board and "VELCRO" pile strips 24 attached longitudinally to the markers 22.

Figure 2:
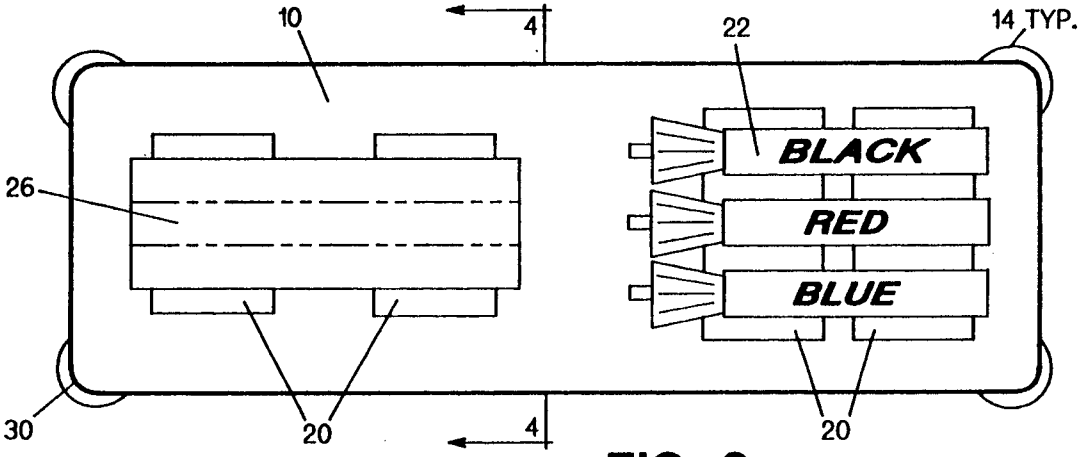
FIG. 2 is an elevational view of the backside of the dry-erase message board.
Figure 4:
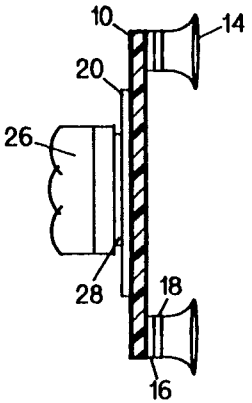
FIG. 4 is a cross-sectional view taken in the plane of line 4—4 of FIG. 2.

FIG. 2 shows the backside of the message board 10. Attached to the backside are the "VELCRO" hook strips 20 that are used to hold and secure both the dry-erase eraser 26 and several dry-erase markers 22 of different colors. FIG. 4 shows a cross-sectional view of FIG. 2 whereby the message board 10 and a dry-erase eraser 26 are attached to each other by the "VELCRO" hook and pile strips 20 and 28, respectively. The hook strips 20 are attached to the backside of the marking board 10 and the pile strip 28 is attached longitudinally to the hand-held side of the eraser 26.

To use the dry-erase message board, the user first pushes the board 10 against the glass of the vehicle's interior window so that the suction cups 14 seal themselves securely onto the glass. The user then pulls the board 10 away from the window whereby the coheasion between the "VELCRO" hook and pile pads 16 and 18 will be broken, thus allowing the board to separate from the suction cups 14. The suction cups 14 will remain sealed to the window since the force between the suction cups and the window glass is greater than the coheasive force between the hook and pile pads 16 and 18. The user then turns the board 10 over and removes the dry-erase markers 22 and the dry-erase eraser 26 and writes or draws a message on the display side of the message board 10. The markers 22 and the erase 26 detach easily from the hook and pile strips 20, 24, 28 provided on the back of the board 10 and also the longitudinal sides of the markers 22 and the hand-held side of the eraser 26. When the user is finished writing a message, the markers 22 and eraser 26 are reattached via the hook and pile strips 20, 24, 28. The board 10 is then pressed once again against the backsides of the suction cups 14 such that the hook and pile pads 16 and 18 align with one another and once again stick together holding the board 10 securely in place vertically on the vehicle window. The user can then repeat this procedure anytime the user wishes to erase a previous message and display a new message.

I claim:

1. A message display kit for detachable mounting on the interior surface of a glass window of a vehicle for spontaneous creation and rapid display of different messages from the interior to the exterior of the vehicle as the need for displaying a particular message arises, said message display kit comprising:

a) an elongated generally rectangular board having front and back sides and including a dry-erase marking surface on said front side thereof on which a spontaneous message may be marked, displayed for viewing from outside the vehicle and subsequently removed and the message erased;

b) means mounted on said board on the front dry-erase marking surface side thereof for detachably attaching said elongated board to the interior surface of said glass window whereby the dry-erase marking surface faces outwardly so that a message thereon may be viewed through the glass window from outside the vehicle;

c) marking surface marker means detachably secured to the back side of said board and selectively detachable therefrom for use to mark a message to be displayed on said marking surface and thereafter detachably securable again to the back side of said board to provide easy access thereto;

d) said means mounted on said board on the dry-erase marking surface thereof for detachably attaching said elongated board to the glass window including at least two glass-adhering suction cups;

e) said glass adhering suction cups for detachably attaching said elongated board to said window being themselves detachably attached on said board on the dry-erase marking surface thereof to provide two-way detachability of said board from said window; and f) selectively detachable interengageable hook and pile means interposed between the front side of said board and the back side of said glass adhering suction cups.

2. A message display kit adapted when assembled for detachable mounting on the interior surface of a glass window of a vehicle for spontaneous creation and rapid display of different messages from the interior of the vehicle as the need for displaying a particular messages arises, said message display kit comprising:

a) an elongated generally rectangular board having front and back sides and including a dry-erase marking surface on said front side thereof on which a spontaneous message may be marked, displayed and subsequently erased;

b) at least two glass-adhering suction cups selectively separably mounted on said board on the front side thereof and oriented thereon whereby when said suction cups are attached to the interior surface of said glass window the dry-erase marking surface faces outwardly so that a message thereon may be viewed through the glass window from outside the vehicle; and c) a plurality of detachably interengageable hook and pile means operatively disposed between said front side of said board and said at least two glass adhering suction cups whereby said suction cups may be detachably attached to the front side of said board for use in attaching said board to said window and said display board may be separated from said suction cups by separation of said hook and pile means to enable erasure of a message thereon and the substitution of another and said board then detachably re-applied to said suction-cups for display of the substituted message.

3. The combination according to claim 2, in which marker means for marking a message on said dry-erase marking surface are detachably mounted on said back side of said elongated board for selective separation therefrom to mark a message on said board and then replaceable on the back side of said board when not in use.

4. The combination according to claim 2, in which eraser means are detachably mounted on said back side of said elongated board and selectively separable therefrom to erase a message marked on said marking surface and thereafter detachably securable on the back side of said board.

5. The combination according to claim 2, in which four glass-adhering suction cups are provided detachably mounted on said elongated board one each adjacent each corner thereof.

* * * * *